US006065658A

United States Patent [19]

Hashimoto

[11] Patent Number: 6,065,658

[45] Date of Patent: May 23, 2000

[54] TOOL HOLDER FOR AN ELECTRIC DRILL

[76] Inventor: Richard Makoto Hashimoto, 1521 O'Farrell St., San Francisco, Calif. 94115

[21] Appl. No.: 09/110,427

[22] Filed: Jul. 2, 1998

[51] Int. Cl.[7] ..... A45F 3/04

[52] U.S. Cl. ..... 224/647; 224/637; 224/254; 224/904

[58] Field of Search ..... 224/191, 162, 224/600, 603, 623–627, 638, 645, 646, 250, 235, 236, 254, 259, 262, 904, 911; 206/38; 42/94

[56] References Cited

U.S. PATENT DOCUMENTS

| | | | |
|---|---|---|---|
| 1,037,717 | 9/1912 | Audley | 224/624 X |
| 1,290,827 | 1/1919 | Yergason | 224/623 |
| 1,884,328 | 10/1932 | Sperling | 224/623 X |
| 2,089,402 | 8/1937 | Murray | 224/624 |
| 2,396,118 | 3/1946 | Ohlemeyer | 224/911 X |
| 2,620,479 | 12/1952 | Buck | 224/638 X |
| 2,793,617 | 5/1957 | Palmer | 224/162 |
| 3,087,277 | 4/1963 | McCook | 224/625 X |
| 3,227,337 | 1/1966 | Santo, Jr. | 224/911 X |
| 3,885,722 | 5/1975 | Robertson | 224/264 X |
| 4,764,962 | 8/1988 | Ekman et al. | 224/259 X |
| 4,903,874 | 2/1990 | Shoemaker | 224/911 X |
| 5,009,022 | 4/1991 | McCoy | 42/94 |
| 5,246,153 | 9/1993 | Beletsky | 224/624 X |
| 5,263,618 | 11/1993 | Talavera | 224/624 X |
| 5,524,749 | 6/1996 | Thompson et al. | 206/38 |
| 5,653,336 | 8/1997 | Buonaiuto et al. | 224/624 X |
| 5,775,558 | 7/1998 | Montalbano | 224/627 |

*Primary Examiner*—Gregory M. Vidovich
*Attorney, Agent, or Firm*—Risto A. Rinne, Jr

[57] ABSTRACT

An apparatus for holding an electric drill that is worn by a user is described as including a pair of shoulder straps that pass over opposite shoulders of the user and which attach to a belt that is worn about the waist of the user at the front and back of the user. The belt is adjustable about the waist of the user. A holster is attached to one of the pair of shoulder straps intermediate the waist and one of the opposite shoulders of the user that is adapted to receive the electric drill therein. An optional wrap-around strap further secures the electric drill in the holster when it is not in use and an optional tether that is attached at one end to the tool holder and at a remaining end to the electric drill are provided as desired. An optional accessory pouch is attached to the one of the pair of shoulder straps opposite to where the holster is attached. An optional adjustable center strap is attached to each of the pair of shoulder straps and is disposed intermediate thereto in the front of the user. According to a modification the pair of shoulder straps include a hook and a loop fastener attached thereto at each end thereof which permit attachment of the pair of shoulder straps to a tool belt or to a convention type of a belt that worn about the waist of the user and is used to hold up a pair of trousers.

11 Claims, 1 Drawing Sheet

TOOL HOLDER FOR AN ELECTRIC DRILL

BACKGROUND OF THE INVENTION 1. Field of the Invention

The present invention, in general relates to tool holders and, more particularly, to a tool holder that is adapted to hold an electric drill.

Contractors frequently use electric drills for various purposes. Often they use portable battery powered electric drills, known generally as "cordless" drills to eliminate the interference that might otherwise be caused by an electrical cord or extension cord of a conventional corded-type of a drill that plugs into an electrical outlet.

Frequently, contractors still use corded drills for certain special purposes, such as for continuous duty application where batteries are apt to need frequent recharging or replacement.

Sometimes, contractors climb and work directly off of a ladder and sometimes they work on elevated platforms, commonly known as scaffolding. In either case, an acute danger associated with electric drills exists and that is the danger of dropping the drill. This applies to both cordless and corded drills.

Not only is there risk that the drill can fall from the ladder or scaffolding and be ruined upon impact, but there is danger that it can injure contractors or other personnel that happen to be located below the ladder or scaffolding. This possibility presents a potentially serious threat to safety. A heavy cordless drill falling onto the head of a contractor or a person standing below can result in serious injury and even death under certain circumstances.

In any event, there is a need to secure the drill to the user in some fashion that is convenient for working. Typical holsters that attach to a belt that is worn about the waist are not effective, especially for cordless drills, because they do not adequately secure the drill in place.

A cordless drill has a heavy battery that is typically disposed in the handle. This makes the handle very heavy which in turn causes it to pivot when placed in a conventional drill holster that is disposed about the waist of the user. The cordless drill will continue to pivot until it is disposed at such an angle that it can fall out of the holster.

The tilting action of the holster makes it inconvenient to remove a drill therefrom even when the drill remains confined within the holster because the tilting action disposes the handle of the cordless drill at an inconvenient angle for the user to grasp.

Also waist holsters tend to interfere with conventional tool belts that are worn about the waist. As such, the user/contractor is forced to choose between transporting the tools that he would like to carry in the conventional tool belt or transporting the drill in the holster. When the contractor needs both at or near the same time, this creates a problem. For example, when working off of a ladder the contractor may desire to simultaneously carry with him the cordless drill, a variety of drill bits, a hammer, a pencil, a tape measure, an assortment of screws, an assortment of nails, and other items as well.

The current solution to such a dilemma is to not rely upon a holster for transport of the cordless drill, but merely to hook the drill onto a support of some sort, such as onto the rung of a ladder. Usually, only the top rung is typically fitted with a hook for holding the drill. Also, the present methods for securing the drill in this manner tend to be ineffective at retaining the drill if, for example, it is bumped during suspension from the ladder.

Accordingly there exists today a need for an apparatus which can adequately secure an electric drill to a user in such manner as to provide convenient access to the drill and also permit the user to wear a tool belt, if desired. Clearly, such an apparatus would be a useful and desirable device.

2. Description of Prior Art

Various tool and drill holders are, in general, known. For example, the following patents describe various types of these devices and they also cite at least one holster specifically designed to secure a handgun, not a power tool, and as such even though it is included it is not considered to be analogous art by the applicant inasmuch as each category solves a different problem:

U.S. Pat. No. 1,723,147 to Fourethier, Aug. 6, 1929;

U.S. Pat. No. 4,828,154 to Clifton, Jr., May 9, 1989;

U.S. Pat. No. 4,962,873 to Schattel, Oct. 16, 1990;

U.S. Pat. No. 5,211,321 to Rodriguez, May 18, 1993;

U.S. Pat. No. 5,269,448 to Shoemaker, Dec. 14, 1993;

U.S. Design Pat. No. D 333,215 to Brown, Feb. 16th, 1993; and

U.S. Design Pat. No. D 361,658 to Martin, Aug. 29, 1995.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a tool holder for an electric drill that can be worn by a user.

It is also an important object of the invention to provide a tool holder for an electric drill that is adapted to receive an electric drill therein.

Another object of the invention is to provide a tool holder for an electric drill that is adapted to secure a cordless drill therein.

Still another object of the invention is to provide a tool holder for an electric drill that provides convenient access to insert the drill into the tool holder or to remove it therefrom.

Still yet another valuable object of the invention is to provide a tool holder for an electric drill that is comfortable for the user to wear.

Yet another important object of the invention is to provide a tool holder for an electric drill that includes a tether cord that can be attached to the drill.

Yet another especially important object of the invention is to provide a tool holder for an electric drill that can hold accessories as well as the electric drill.

Still yet one further object of the invention is to provide a tool holder for an electric drill that also accommodates the wearing of a tool belt.

Yet another important object of the invention is to provide a tool holder for an electric drill that includes at least one strap draped over the shoulder of a user and a holster that is adapted to receive the drill being attached to the one strap.

Still yet another important object of the invention is to provide a tool holder for an electric drill which includes a holster adapted to receive a drill that is disposed intermediate a waist and a shoulder of a user.

Briefly, a tool holder for an electric drill that is constructed in accordance with the principles of the present invention has at least one strap that is draped over the shoulder of a user and which extends down toward the waist of the user and along the front half of the user. Disposed intermediate the waist and the shoulder a holster is attached to the strap at a predetermined angle. The holster includes a cavity that is adapted to receive an electric drill therein. Additional means for retaining the drill in the holster are provided, as desired, and include a strap that wraps around the rear of the drill to secure it in the holster.

DETAILED DESCRIPTION OF THE INVENTION

Figure 1:
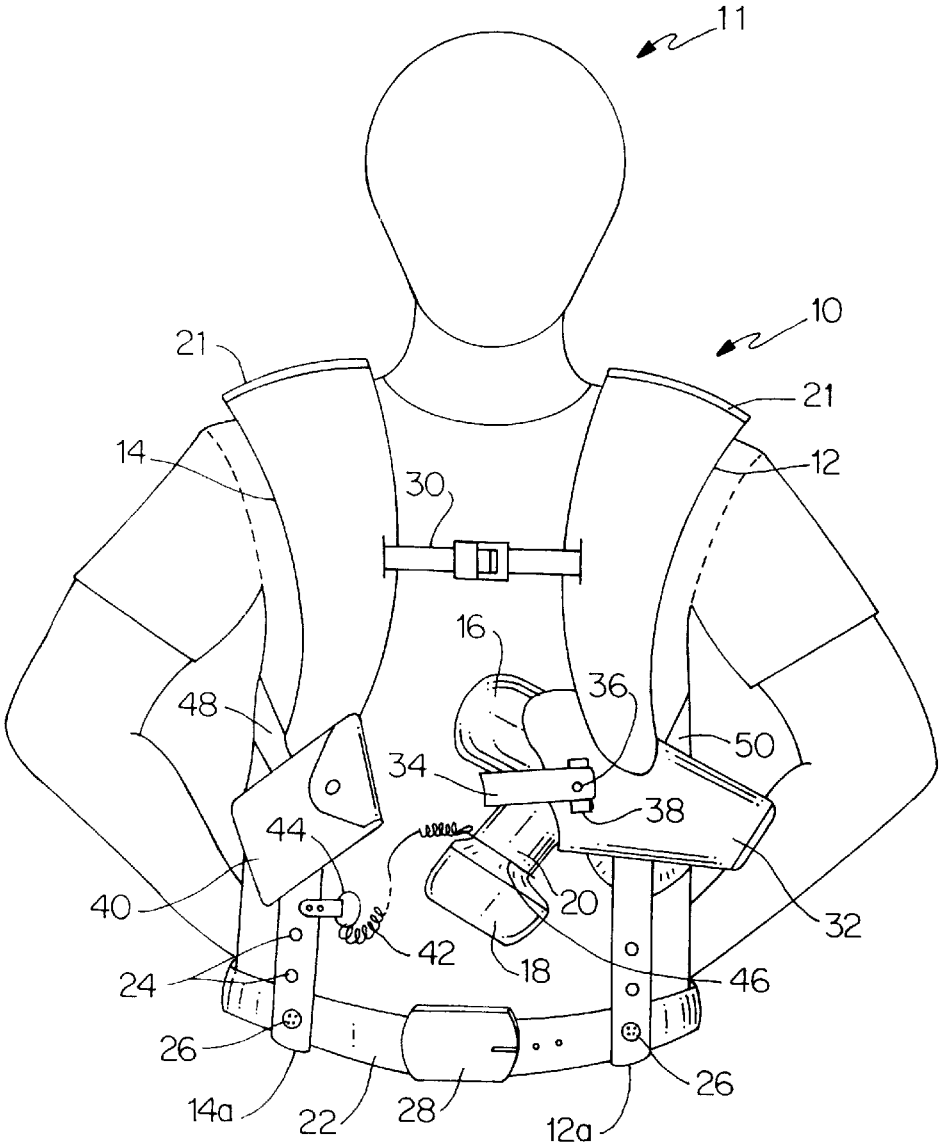
FIG. 1 is a front elevational (plan) view of a tool holder for an electric drill disposed about a user.

Referring to FIG. 1 is shown, a tool holder for an electric drill, identified in general by the reference numeral 10, and hereinafter referred to as "the tool holder 10". The tool holder 10 is worn about a user, identified in general by the reference numeral 11.

The tool holder 10 includes a pair of wide shoulder straps 12, 14 each of which are draped over opposite shoulders of the user 11. The straps 12, 14 are wide in the area immediately over the shoulders to distribute the weight of an electric drill 16. The electric drill 16 as shown is a cordless type of a drill that includes a battery 18 that is partially contained within a handle 20 of the drill 16. As such the drill 16 is heavy and the especially great width of the straps 12, 14 over the shoulders distributes this weight over a greater area to improve comfort for the user 11.

A layer of padding 21 is added to the straps 12, 14 directly over the shoulders as desired to provide even greater cushioning and weight distribution over the shoulders of the user 11. As the tool holder 10 may be worn for many hours continuously, each of the layers of padding 21 can provide extra comfort for the user 11. The padding 21 is provided on a deluxe model but may be eliminated from an economy model (not shown) of the tool holder 10, as desired.

Each of the straps 12, 14 extends along the back (not shown) of the user 11 down to a waist belt 22 where they are each attached at a first end thereof to the waist belt 22. Each of the straps 12, 14 extends down along the front of the user 11 to the waist belt 22 where they are each attached at a remaining end 12*a*, 14*a* to the waist belt 22.

The remaining ends 12*a*, 14*a* each include a plurality of adjustment holes, identified by the reference numeral 24. Any of the adjustment holes 24 on each of the straps 12, 14 is used to secure the remaining ends 12*a*, 14*a* to the waist belt 22 by passing a button 26 that is attached to the waist belt 22 therein.

Many possible ways of attaching the remaining ends 12*a*, 14*a* to the waist belt 22 are contemplated including, but not limited to, the use of a special hook and loop fastener (not shown) that is sold under the trade name VELCRO or by use of a snap fastener. An alternate way of attaching the remaining ends 12*a*, 14*a* is discussed in greater detail hereinafter.

The waist belt 22 includes a conventional type of a buckle 28 for adjusting and securing the waist belt 22 to the user 11.

An adjustable center strap 30 is attached to the straps 12, 14 on either side thereof and is used to keep the shoulder straps 12, 14 from increasing the distance intermediate them and possibly sliding off of the shoulders of the user 11.

A holster 32 is attached to one of the shoulder straps 12, 14. The holster 32, as shown, is attached to the shoulder strap 12 that passes over the left shoulder of the user 11. This is preferred if the user 11 is right-handed. If the user 11 were instead left-handed, the holster 32 would then be attached to the shoulder strap 14 that passes over the right shoulder of the user 11 and, essentially, a mirror image of the tool holder 10, as is herein described, would be manufactured.

The holster 32 is attached to that portion of the strap 12 located at the front of the user 11 intermediate the waist belt 22 and the shoulder of the user 11 at a predetermined angle with the nose of the holster 32 pointing slightly downward so as to tend to keep the drill 16 disposed in the holster 32 and also to allow easy insertion and withdrawal of the drill 16 into and from the holster 32 respectively.

The holster 32 includes a cavity that is sized to fit any particular model of the drill 16 or it can be made flexible so as to accommodate a variety of sizes of the drill 16 as are produced by the various tool manufacturers. The holster 32 is formed of any preferred material, including but not limited to, cloth, leather, and plastic. It is secured to the strap 12 by whatever method is preferred, including but not limited to, sewing, stitching, adhesives, VELCRO, or any known type of a fastener.

A wrap-around strap 34 is attached to the holster 32 at one end thereof on the side of the holster 32 proximate the chest of the user 11 and is detachably attached to the holster 32 at an opposite end by the use of a snap-fastener 36 or a hook and loop fastener 38 such as is currently being sold under the trade name VELCRO to secure the drill 18 in place within the holster 32. Either the snap-fastener 36 or the hook and loop fastener 38 are used to secure the opposite end of the wrap-around strap 34 to the holster 32 but not both at the same time.

The wrap-around strap 34 passes around the handle 20 of the drill 16 thus securing it in place. The wrap-around strap 34 prevents any possibility that the drill 16 might fall out of the holster 32 if the weight of the drill 16, and especially the weight of the battery 18, were to cause the drill 16 to rotate the holster 32 counterclockwise, as shown in the FIG. 1 drawing.

An accessory pouch 40 is provided as an option that is attached to the shoulder strap 14 that does not have the holster 32 attached thereto. The accessory pouch 40 is used to contain whatever accessories, parts, or other tools are desired by the user 11 such as drill bits, screws, a drill-chuck key, or the like.

A tether 42 is provided, if desired, to provide an even greater level of safety to prevent the drill 16 from falling away from the tool holder 10. The tether 42 is attached at a proximate end to a ring 44, the ring 44 preferably being secured to the strap 14 that does not have the holster 32 attached thereto.

The tether 42 includes an opposite distal end that is attached to the drill 16. As shown, the distal end of the tether 42 includes a loop 46 that surrounds the handle 20 of the drill 16. The loop 46 may be placed around the handle 20, preferably at the base thereof, when the battery 18 has been removed from the drill 16. Once the battery 18 is inserted into the handle 20, it typically is latched in position according to whatever method each manufacturer prefers.

If the drill 16 were inadvertently dropped, the tether 42 would limit the amount the drill 16 could fall in accordance with its length. The battery 18, being latched in position, would prevent the battery 18 from being pulled out of the handle 20 when the drill 16 was dropped and the tether 42 was stretched to its maximum.

The tether 42 includes a coiled portion intermediate the ring 44 and the loop 46. The coiled portion serves two primary functions simultaneously. First, because its length when stretched exceeds its retracted length, it forms a relatively small loop that does not interfere with the user 11 when the drill 16 is in the holster 32 yet it stretches during use to allow the user 11 to reach where desired. Second, if the drill 16 were to be dropped by the user 11, some of the energy of the fall would be absorbed by the coiled portion of the tether 42 as it was stretched to its maximum length, thereby lessening the severity of the jolt experienced when the tether 42 is fully stretched.

A first side 48 and a second side 50 of a center support strap are shown each attached respectively to one of the shoulder straps 12, 14 or alternatively, to the holster 32 and to the accessory pouch 40. The center support strap is an optional component of the tool holder 10 that passes around the back of the user 11 intermediate the waist and the shoulder of the user 11, nearly parallel with the height of the holster 32 and proximate the thorax of the user 11. The center support strap is variable in length to adjust to the size of the user 11 by any preferred means, including the use of an elastic.

The center support strap supplies a force which tends to urge the holster 32 and the accessory pouch 40 further apart with respect to each other. As this force is counter to the force imposed by the adjustable center strap 30, a tension is created which tends to keep the various component parts of the tool holder 10 in position about the user 11.

The adjustable buckle 28 on the waist belt 22, the adjustable center strap 30 intermediate the straps 12, 14, and the adjustable length straps 12, 14 provide the tool holder 10 with ample means of adjustment to fit the particular size of the user 11. The tool holder 10 may be adjusted to accommodate a wide variety of sizes of the user 11.

Of course, if desired, the tool holder 10 may be manufactured in specific sizes offering either no adjustment in size or only a limited adjustment in size or it may be offered as described in a relatively few overall sizes designed to accommodate the user 11 having a physique ranging from very small to very large. For example, a small, medium, large, and extra large version of the tool holder 10 may be offered.

The waist belt 22 may function, if desired, as a tool belt in that any of the known conventional tool holders such as nail pouches (not shown), hammer holders (not shown), hand tool pouches (not shown), tape measure pouches (not shown) and the like may also be attached to the waist belt 22. Accordingly, the user 11 is able to transport both the drill 16 and whatever other tools (not shown) that he desires.

Alternatively, a conventional tool belt (not shown) may be worn by the user 11 atop the waist belt 22 of the tool holder 10.

Figure 2:
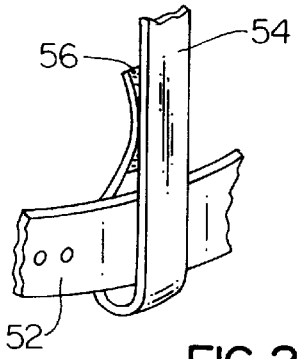
FIG. 2 is a view in perspective of a segment of a modified belt and a segment of a modified strap of the tool holder.

Referring now also to FIG. 2, a portion of a modified belt 52 is shown. The modified belt 52, as shown, is a conventional belt that is used to hold up a pair of trousers (not shown) or it is a tool belt with the various tool and accessory holders omitted so as provide an increased clarity of view of the improvements as are herein described.

An end-portion of a modified strap 54 is shown that is generally similar to either of the straps 12, 14 except the end of the modified strap 54 includes a corresponding segment of a hook and loop fastener 56, such as is sold under the trade name VELCRO, attached near each end thereof. While only one end of the modified strap 54 is shown, a distal end (not shown) is similarly constructed and is used for attachment to the modified belt 52 at the rear of the user.

The hook and loop fastener 56 includes both a hook portion and a loop portion that are each attached on the same side of the modified strap 54 near each end but disposed a predetermined distance from each other so as to allow room for the end of the modified strap 54 to pass around the modified belt 52. Each end of the modified strap 54 is placed around the modified belt 52 and each portion of the hook and loop fastener 56 are placed in contact with each other so as to secure each end of the modified strap 54 in position around the modified belt 52.

Accordingly, modification is made to the tool holder 10, as desired, to include the modified strap 54 when attachment to a modified belt 52 is desired. The remainder of the tool holder 10 is not changed from that as was hereinabove described.

The modifications, as herein described, allows for use of the tool holder 10 with either a conventional trousers' belt or with a conventional tool holder, either of which is identified in the FIG. 2 drawing as the modified belt 52. Also, the modified strap 54 allows for convenient size adjustment of the tool holder 10 to fit the user 11 and may, if desired, be used with the waist belt 22 as a method of attachment thereto as well.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A tool holder for an electric drill to be worn by a user, comprising:

(a) a first strap having a first end and an opposite second end, said first strap adapted to be disposed over a first shoulder of said user and extending down to a location proximate a waist of said user;

(b) a holster adapted to receive said electric drill therein, said holster disposed on said first strap intermediate said first shoulder and said waist of said user;

(c) a waist belt adapted to be disposed around said waist of said user and wherein said first end and said second end of said first strap includes means for attaching to said waist belt;

(d) a wrap-around strap attached at one end thereof to said holster that is adapted for passing around said drill when said drill is inserted in said holster and including means for detachably attaching a remaining end of said wrap-around strap to said holster;

(e) a second strap having a first end and a second end that each include second means for attaching to said waist belt, said second strap adapted to be disposed over a second shoulder of said user; and (f) a tether that is attached at one end thereof to said second strap and is adapted to be attached to said drill at a remaining end thereof;

whereby said user is able to readily insert said electric drill into said holster and is able to readily remove said electric drill from said holster.

2. The tool holder for an electric drill of claim 1 wherein said means for detachably attaching a remaining end of said wrap-around strap to said holster includes a snap-fastener, a portion of which is attached to said holster and a remaining portion of which is attached to said wrap-around strap.

3. The tool holder for an electric drill of claim 1 wherein said means for detachably attaching a remaining end of said wrap-around strap to said holster includes a hook and loop fastener, a portion of which is attached to said holster and a remaining portion of which is attached to said wrap-around strap.

4. The tool holder for an electric drill of claim 1 wherein said first means for attaching includes at least one button attached to said waist belt and first button hole in said at least one strap.

5. The tool holder for an electric drill of claim 1 wherein said first means for attaching includes a hook portion of a hook and loop fastener that is attached proximate to said first end and a loop portion of a hook and loop fastener that is attached proximate to said first end a predetermined distance from said hook portion, whereby said first end is adapted to be placed partially around the waist belt that is disposed around said waist of said user whereby said hook portion is adapted to make contact and cooperate with said loop portion, whereby said hook and loop fastener is adapted to secure said first end of said first strap to said waist belt.

6. The tool holder for an electric drill of claim 1 wherein said first means for attaching includes a hook portion of a hook and loop fastener that is attached proximate to said second end and a loop portion of a hook and loop fastener that is attached proximate to said second end a predetermined distance from said hook portion, whereby said second end is adapted to be placed partially around the waist belt that is disposed around said waist of said user whereby said hook portion is adapted to make contact and cooperate with said loop portion, whereby said hook and loop fastener is adapted to secure said second end of said first strap to said waist belt.

7. The tool holder for an electric drill of claim 1 including an adjustable center strap disposed intermediate said first strap and said second strap, said adjustable center strap limiting the maximum separation of said first strap from said second strap.

8. The tool holder for an electric drill of claim 1 including an accessory pouch that is attached to said second strap intermediate said waist and said second shoulder.

9. The tool holder for an electric drill of claim 1 including a center support strap that is attached at a first end to said first strap and is attached at a second distal end to said second strap and which is adapted to pass around a back of said user intermediate said waist and said shoulder of said user.

10. The tool holder for an electric drill of claim 1 wherein said first strap and said second strap each include a wider portion intermediate said first and second ends where said first strap and said second strap are adapted to respectively pass over said first and said second shoulders of said user.

11. The tool holder for an electric drill of claim 10 wherein each said wider portion includes a padding.

* * * * *